US005117945A

United States Patent [19]

Honda

[11] Patent Number: 5,117,945

[45] Date of Patent: Jun. 2, 1992

[54] COUNTERWEIGHT APPARATUS FOR A TRACTION-TYPE ELEVATOR

[75] Inventor: Takenobu Honda, Aichi, Japan

[73] Assignee: Mitsubishi Denki Kabushiki Kaisha, Japan

[21] Appl. No.: 621,980

[22] Filed: Dec. 4, 1990

[30] Foreign Application Priority Data

Dec. 5, 1989 [JP] Japan ..... 1-314444

[51] Int. Cl.[5] ..... B66B 11/04

[52] U.S. Cl. ..... 187/20; 187/94

[58] Field of Search ..... 187/1 R, 20, 95, 94; 59/78

[56] References Cited

U.S. PATENT DOCUMENTS 1,978,273 10/1934 Lundberg et al. ..... 187/1 R
4,716,989 1/1988 Coleman et al. ..... 187/1 R

FOREIGN PATENT DOCUMENTS 50-48646 4/1975 Japan .
57-170376 10/1982 Japan .
62-235179 10/1987 Japan .
62-280179 12/1987 Japan .

*Primary Examiner*—Robert P. Olszewski
*Assistant Examiner*—Kenneth Noland
*Attorney, Agent, or Firm*—Leydig, Voit & Mayer

[57] ABSTRACT

A non-box-counterweight apparatus for a traction type elevator has a counterweight-side hoisting rope and a counterweight-side compensating rope with a total weight between about three and seven times the weight of the maximum cage load. The weight of the counterweight-side ropes serves a counterweighting function, and a guided box-type counterweight is unnecessary.

8 Claims, 2 Drawing Sheets

COUNTERWEIGHT APPARATUS FOR A TRACTION-TYPE ELEVATOR

This invention relates to elevators and more particularly to a counterweight apparatus for traction type elevators.

BACKGROUND OF THE INVENTION

Heretofore, a counterweight apparatus for traction type elevators has utilized a box type counterweight requiring a guide rail for guiding the counterweight. Such an apparatus, when used in a high-speed and high-lift elevator, is noisy and produces shocks when it passes by an elevator cage.

SUMMARY OF THE INVENTION

The principle object of this invention is to provide a counterweight apparatus for traction type elevators which utilizes a rope as the counterweight structure instead of a box type counterweight which needs a guide rail.

Another object is to provide a non-box-counterweight apparatus for a high-speed and high-lift elevator which is quiet in operation and produces little vibration.

DESCRIPTION OF THE PREFERRED EMBODIMENTS

Figure 3:
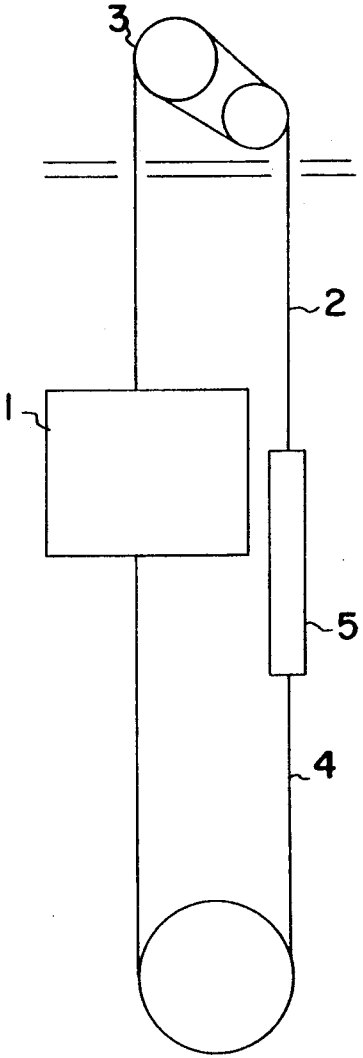
FIG. 3 is a view of a prior art apparatus.

First, a conventional counterweight apparatus will be described while referring to FIG. 3. This counterweight apparatus for traction type elevators is described in Japanese Publication No. 30876/83 and Japanese Provisional Publication No. 235179/87. In this apparatus, a counterweight 5 is of the box type and requires a rail for guiding it. Each side of the counterweight 5 is connected to each side of an elevator cage 1 by a hoist rope 2 and a balancing rope 4. The hoist rope 2 is wound about a driving sheave 3 of a headgear between the elevator cage 1 and the counterweight 5. The elevator cage 1 and the counterweight 5 are driven at high speed over a high lift by the driving sheave 3.

However, in the apparatus of FIG. 3, there are the problems that passengers in the cage 1 hear noise and feel shock and vibration caused by air pressure when the box type counterweight 5 passes by an elevator cage, and the apparatus requires a rail for guiding the counterweight 5. The rail which must be installed with precision, involving significant time for installation.

Figure 1:
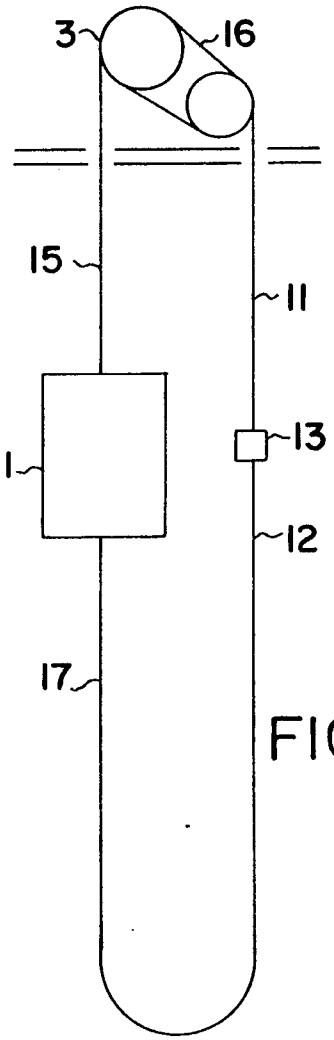
FIG. 1 is a view of a counterweight apparatus for traction type elevators embodying the present invention.

Referring now to FIG. 1, a counterweight apparatus according to this invention includes a cage-side hoisting rope 15 which is connected at one end to the roof of an elevator cage 1, a driving sheave rope 16 which is connected at one end to the other end of the cage-side hoisting rope 15 and which is wound around the driving sheave 3, and a counterweight-side hoisting rope 11 which is connected at one end to the other end of the driving sheave rope 16. A counterweight-side compensating rope 12 has one end connected to the other end of the counterweight-side hoisting rope 11 through a connector 13 which is guided by guiding ropes 14. A cage-side compensating rope 17 has ends respectively connected to the other end of the counterweight-side hoisting rope 17 and the bottom of the elevator cage 1. All of the ropes referred to are preferably of wire rope.

Figure 2:
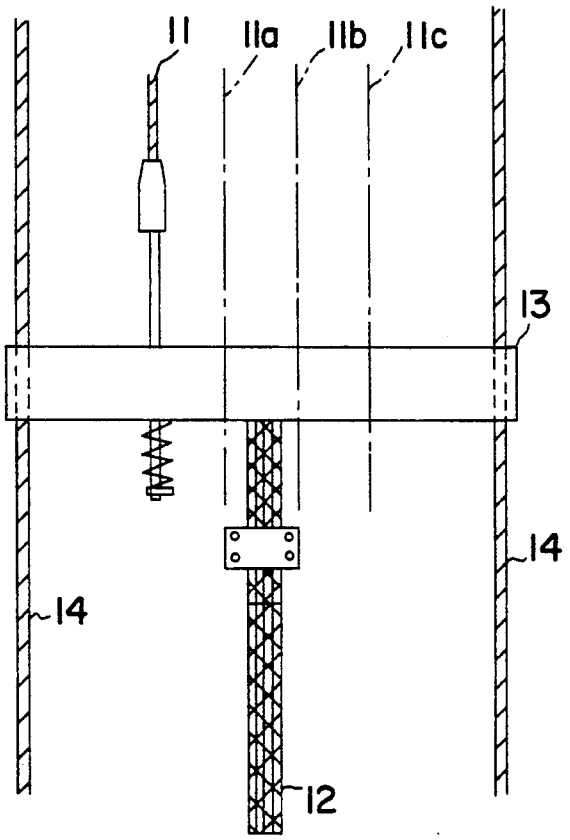
FIG. 2 is a detailed view of a connecting means used in the embodiment of FIG. 1.

The connector 13 is illustrated in greater detail in FIG. 2. The connector 13 can move up and down guided by the parallel guiding ropes 14. The guiding ropes 14 are also made of wire rope. Therefore, installation of the guiding ropes 14 is very easy and does not require precision or extensive time to install. To absorb and thereby minimize the effect of shocks as the cage is raised and lowered, the counterweight side hoisting rope 14 is connected to the connector 13 through a resilient member such as a spring 20. It also will be seen that a plurality of parallel hoisting ropes 11*a -c* may be provided as will be clear from the following description. The connector 13 is also connected through a fixed connection to the counterweight-side compensating rope 12.

In order to avoid the necessity of a counterweight, according to the invention the total weight of the counterweight-side hoisting rope 11 and the counterweight-side compensating rope 12 is at least about three times the weight of the maximum cage load, as shown by the following explanation.

Driving power is transmitted in a traction type elevator to a driving sheave rope 16 relying on friction between the driving sheave rope 16 and the driving sheave 3. Therefore, a traction elevator has a weight difference limit between the counterweight-side and the cage-side below which there is no slip. This limit is a function of the coefficient of friction between the rope and the sheave as set forth in the following Equation (1):

$$e^{\mu\cdot\Theta} > \frac{(L + W_1 + \omega_1 + C_1)(1 + a/g)}{(W_2 + \omega_2 + C_2)(1 - a/g)} \quad (1)$$

$e^{\mu\cdot\Theta}$: limit of slip
$\mu$: coefficient of friction between the rope and the driving sheave
$\Theta$: angle of wind of the rope with respect to the driving sheave
$L$: weight of maximum design load of cage
$W_1$: weight of cage
$W_2$: weight of counterweight
$\omega_1$, $\omega_2$: weight of cage-side hoisting rope 15 and counterweight-side hoisting rope 11
$C_1$, $C_2$: weight of cage-side compensating rope 17 and counterweight-side compensating rope 12.
$g$: acceleration Heretofore, in elevators equipped with a guided counterweight, the values of $\omega_1$, $\omega_2$, $C_1$ and $C_2$ were considered small relative to the value of $W_1$, $W_2$ and L representing the weight of the cage, counterweight and cage load. Therefore, the value of the limit of slip was determined by the values of $W_1$, $W_2$ and L. However, if in the above expression the value of $\omega_1$, $\omega_2$, $C_1$ and $C_2$ are made large relative to the value of $W_1$, $W_2$ and L, the value of the limit of slip can be determined by the weight of the ropes $\omega_1$, $\omega_2$, $C_1$ and $C_2$, i.e., $W_2$ is considered equal to zero.

When $\omega_1$, $\omega_2$, $C_1$ and $C_2$ are considered zero in the calculation, because the values are small in comparison with L, $W_1$, and $W_2$, then $$\frac{L + W_1 + \omega_1 + C_1}{W_2 + \omega_2 + C_2} = \frac{L + W_1}{W_2} \quad (2)$$

In contrast, when $W_2$ is considered zero, then $$\frac{L + W_1 + \omega_1 + C_1}{W_2 + \omega_2 + C_2} = \frac{L + W_1 + \omega_1 + C_1}{\omega_2 + C_2} \quad (3)$$

In Equations (2) and (3), based on a typical construction of a high-speed high-lift elevator, the values of the variables may be approximated for simplification as $W_1=L$, $W_2=0.5L+W_1$, $C_1=\omega_2$, and $C_2=\omega_1$. Therefore, the limit of slip may first be calculated using Equation (2) for the case where a guided counterweight is employed:

$$\frac{L + W_1}{W_2} = \frac{L + L}{0.5L + W_1} = \frac{2L}{1.5L} = 1.33$$

Then, using this calculated value of slip in Equation (3), the unknown values of $\omega_1$, $\omega_2$, $C_1$ and $C_2$ for the weight of the ropes may be calculated for a typical non-box-counterweight elevator (the portion of the expression $(1+a/q)/(1-a/g)$ being the same for either a box-type counterweight or non-box-counterweight elevator) as follows:

$$\frac{L + W_1 + \omega_1 + C_1}{\omega_2 + C_2} = \frac{2L + (\omega_2 + C_2)}{\omega_2 + C_2} \quad (4)$$

$$1.33 = \frac{2L + (\omega_2 + C_2)}{\omega_2 + C_2}$$

$$\omega_2 + C_2 = 6.1\,L.$$

Equation (4) indicates that if the weight $(\omega_2+C_2)$ of the counterweight-side ropes 11,12 is between six and seven times the weight of the maximum cage load, a high speed high-lift traction type elevator of typical construction can be made without a box type counterweight.

As an actual example, using the calculated value of Equation (4), if the maximum cage load is 3,000 Kg, the weight of the counterweight-side ropes needs to be about 18,000 Kg. If the counterweight-side ropes comprise more than ten ropes each of which has a diameter of more than 20 mm and the length of the counterweight-side ropes is more than 1,300 m, a weight of 18,000 kg is achieved by such an arrangement of ten ropes (unit weight of rope having a diameter of 20 mm is about 1.4 Kg/m).

Therefore, this invention is especially applicable for high-speed and high-lift traction type elevators. For example, high-speed means a speed of more than 200 m/min, and high-lift means a lift of more than 100 m.

However, if the weight L of the cage load or the weight $W_1$ of the cage is lighter than in the above example, the angle $\theta$ of wind of a rope about a driving sheave is larger than in the above example, or the coefficient of friction $\mu$ between the rope and the driving sheave is larger than in the above example, the length of the counterweight side-ropes can be less than 1,300 m.

Further, in the above calculations the weight $W_2$ of the counterweight was assumed to be 0.5 times the weight of the cage load L plus the weight $W_1$ of the cage. However, the weight $W_2$ of the counterweight may be 0.4 times as the heavy as weight of the cage load L plus the weight $W_1$ of the cage. In this case, the weight $(\omega_2+C_2)$ of counterweight-side ropes can be between three and four times the weight of the cage load, and the length of the counterweight-side ropes may be about 850 m.

Also, in the above example, the unit weight of the rope was assumed to be about 1.4 kg/m. However, the unit weight of the rope may be larger than the assumed weight if the diameter of the rope is increased, for example. The diameter of the of rope may be constant, or it may vary so as to be larger in some portions of the rope arrangement than in other portions. Other variations may be made in keeping with the invention to eliminate a guided box-counterweight and utilize the weight of the counterweight-side ropes to serve a counterweighting.

I claim:

1. A traction-type elevator comprising:

a cage-side hoist rope having a first end connected to a roof of an elevator cage and a second end;

a drive sheave rope wound around a drive sheave and having a first end connected to the second end of the cage-side hoist rope and a second end;

a counterweight-side hoist rope having a first end connected to the second end of the drive sheave rope and a second end;

a counterweight-side compensating rope having a first end connected to the second end of the counterweight-side hoist rope and a second end; and a cage-side compensating rope having a first end connected to the second end of the counterweight-side compensating rope and a second end connected to a bottom of the elevator cage, wherein the combined weight of the counterweight-side hoist rope and the counterweight-side compensating rope is sufficient to counterweight the elevator cage when carrying a maximum design load without the use of a counterweight.

2. An elevator as claimed in claim 1 wherein the combined weight is between approximately 3 and approximately 7 times the loaded weight of the elevator cage when carrying a maximum design load.

3. An elevator as claimed in claim 2 wherein the combined weight is approximately 4 to approximately 6 times the loaded weight of the elevator cage when carrying a maximum design load.

4. An elevator as claimed in claim 1 further comprising a guide rope and a connector guided by the guide rope and connecting the second end of the counterweight-side hoist rope and the first end of the counterweight-side compensating rope.

5. An apparatus as claimed in claim 4 wherein the connector is resiliently connected to the counterweight-side hoist rope and nonresiliently connected to the counterweight-side compensating rope.

6. A high-speed, high-lift traction-type elevator comprising:

a cage-side hoist rope having a first end connected to a roof of an elevator cage and a second end;

a drive sheave rope wound around a drive sheave and having a first end connected to the second end of the cage-side hoist rope and a second end;

a counterweight-side hoist rope having a first end connected to the second end of the drive sheave rope and a second end;

a counterweight-side compensating rope having a first end connected to the second end of the counterweight-side hoist rope and a second end; and a cage-side compensating rope having a first end connected to the second end of the counterweight-side compensating rope and a second end connected to a bottom of the elevator cage, wherein the approximate combined weight ($\omega_2+C_2$) of the counterweight-side hoist rope and the counterweight-side compensating rope satisfies the following equation:

$$\frac{L + W_1 + \omega_1 + C_1}{\omega_2 + C_2} = 1.33$$

wherein

L is the maximum design load of the elevator cage, $W_1$ is the weight of the elevator cage, $\omega_1$ is the weight of the cage-side hoist rope, $\omega_2$ is the weight of the counterweight-side hoist rope, $C_1$ is the weight of the cage-side compensating rope, $C_2$ is the weight of the counterweight-side compensating rope, $C_1=\omega_2$ and $C_2=\omega_1$.

7. An apparatus as claimed in claim 6 further comprising a connector resiliently connected to the second end of the counterweight-side hoist rope and nonresiliently connected to the first end of the counterweight-side compensating rope.

8. An elevator comprising:

an elevator cage having a top and a bottom;

a drive sheave;

a cage-side hoist rope having a first end connected to the top of the elevator cage and a second end;

a drive sheave rope wound around the drive sheave and having a first end connected to the second end of the cage-side hoist rope and a second end;

a counterweight-side hoist rope having a first end connected to the second end of the drive sheave rope and a second end;

a counterweight-side compensating rope have a first end connected to the second end of the counterweight-side hoist rope and a second end; and a cage-side compensating rope having a first end connected to the second end of the counterweight-side compensating rope and a second end connected to the bottom of the elevator cage, wherein substantially the entire force counterweighting the elevator cage during operation of the elevator is the combined weight of the counterweight-side hoist rope and the counterweight-side compensating rope.

* * * * *